US006758158B2

(12) United States Patent
Lakram

(10) Patent No.: US 6,758,158 B2
(45) Date of Patent: Jul. 6, 2004

(54) UNSINKABLE VESSEL SYSTEM

(76) Inventor: Jitendra Lakram, P.O. Box 300, Marcy, NY (US) 13403

( * ) Notice: Subject to any disclaimer, the term of this patent is extended or adjusted under 35 U.S.C. 154(b) by 0 days.

(21) Appl. No.: 10/055,331

(22) Filed: Jan. 25, 2002

(65) Prior Publication Data

US 2002/0078878 A1 Jun. 27, 2002

(51) Int. Cl.[7] ..... B63B 43/12
(52) U.S. Cl. ..... 114/360; 114/68
(58) Field of Search ..... 114/360, 68, 69, 114/54

(56) References Cited

U.S. PATENT DOCUMENTS 1,295,375 A * 2/1919 Ryczek ..... 114/54
1,320,012 A * 10/1919 Lee et al. ..... 114/68
3,121,888 A 2/1964 Morgan et al.
4,348,976 A * 9/1982 Gilbert ..... 114/315
4,458,618 A * 7/1984 Tuffier ..... 114/360
4,512,275 A 4/1985 Drumm
4,817,555 A 4/1989 Meinen
4,864,961 A 9/1989 Slonski
5,309,408 A * 5/1994 Bick et al. ..... 367/909
5,357,888 A 10/1994 Insinna
5,620,306 A * 4/1997 Day ..... 416/185

* cited by examiner

*Primary Examiner*—Sherman Basinger
(74) *Attorney, Agent, or Firm*—Richard L. Huff

(57) ABSTRACT

A system for making closed vessels unsinkable. The separate parts of the system are at least one air compressor, a compression chamber, a compressor/propeller clutch, at least one airbag, heating elements, and a diameter restrictor/gauge track. Additional features of this invention include sonar equipment for warning to avoid potential harm to the vessel and a re-entry system which transfers air from the inflated airbags to the inside of a repaired vessel. Upon activation, the air compressor charges the compression chamber, which, by way of a timed valve, distributes compressed air into inflatable bags.

19 Claims, 17 Drawing Sheets

UNSINKABLE VESSEL SYSTEM

BACKGROUND OF THE INVENTION

1. Field of the Invention

This invention relates to systems which render ships and boats unsinkable.

2. Description of the Related Art

The prior art is aware of supplementary devices which inflate automatically or manually to provide additional buoyancy in the event of water leakage into the vessel. The following is a brief description of the prior art which is pertinent to the present invention.

U.S. Pat. No. 3,121,888 to Morgan et al discloses a protected inflatable member present along the top of the outside surface of the hull. When needed, this inflatable member is filled with gas from a pressurized air cylinder in order to provide a buoyant bag along the top of the boat to keep the boat afloat U.S. Pat. No. 4,512,275 to Drumm discloses a boat which is unsinkable because it is made of polyethylene foam, which will not sink even though the hull becomes filled with water.

U.S. Pat. No. 4,817,555 to Meinen discloses a boat containing a canister of compressed air which is automatically actuated by the rising of a float inside the boat. Upon opening of the canister, longitudinal bags along the top of the hull outside the boat are inflated to keep the boat afloat.

U.S. Pat. No. 4,864,961 to Slonski discloses an auxiliary flotation apparatus for vessels which comprises canisters connected to a source of compressed air, an inclinometer, and an independent power source. When needed, the compressed air is released into the canisters. When pressurized air enters the canisters, a projectile is propelled away from each canister. The projectile ruptures a frangible membrane located flush with the hull of the vessel. The projectile goes beyond the vessel and carries with it an attached inflatable tubular sheath. One end of the tubular sheath is attached to the hull of the vessel. The sheath becomes filled with air from the source of compressed air, providing a buoyant bag on the outside of the vessel to maintain the vessel afloat.

U.S. Pat. No. 5,357,888 to Insinna discloses a vessel having an elongated inflatable buoyancy tube located on the outside of the hull. The tube is connected to a source of compressed air which, when automatically or manually activated, provides air to the buoyancy tube to keep the vessel afloat.

Of the above patents, one prevents boats from sinking because the boat is made from foam plastic. The other patents disclose buoyant bags fitted to the outside of the craft. These bags can do nothing to affect the entry of water into the craft, and they do no more than merely provide buoyancy.

U.S. Pat. No. 4,458,618 to Tufflier is the prior art of which the inventor is aware which is the closest to the present invention. This patent discloses vessels having enclosed areas such as cabins. The vessels are equipped with three inflatable envelopes. A compressed air container is attached to the three envelopes so that, when needed, the envelopes may be automatically or manually inflated to render the boat buoyant. If the event causing water within the craft is a hole in the hull, the inflated envelopes do nothing to keep the water from continuing to come in. Also, repeated contact with the original cause of the damage could cause puncture of one of the envelopes, causing the boat to be capsized.

SUMMARY OF THE INVENTION

A common cause of sinking in vessels is a rupture in the hull. As a result of the rupture, water enters the hull or the space between a double-walled hull and replaces the air. The added weight of the water eventually causes the vessel to weigh more than its volume of water, and sinking results. A way to avoid sinking is to provide bags of air either within the confines of the hull of the vessel or between the walls of a double-hulled vessel. These bags may provide the necessary buoyancy to keep the vessel afloat and/or apply sufficient pressure against the hull as to prevent the entry of water. It is the purpose of the present invention to provide three alternative systems for performing these functions. The time required for a ship to sink is related to the size of the ship and the size of rupture. According to the present invention, while water is filling the hull, air is being forced into air bags by a compressor. Ultimately, the buoyant effect of the filling air bags will meet with the sinking effect of the incoming water. As the compressor is able to compress air at a higher pressure than the incoming water, the bags will begin to expand into areas occupied by water and to push water back out of the rupture. According to the present invention, the air bags are mounted so that when inflated to a maximum pressure, they will be six inches from the inner wall of the hull. This distance reduces the possibility of a piercing of the bags by jagged edges of the rupture while rendering the vessel sufficiently buoyant to remain afloat and operative. The system of the present invention thus gives the crew adequate time to repair the rupture and render the vessel seaworthy.

DESCRIPTION OF THE PREFERRED EMBODIMENTS

Figure 1:
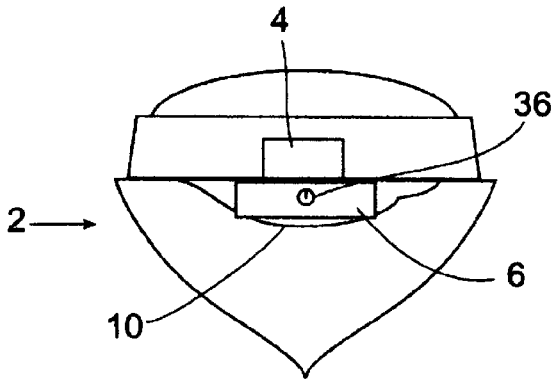
FIG. 1 is an elevational rear view of a vessel of the first embodiment of this invention, partly in cut-away, illustrating a deflated bag during storage, an air compressor, a compression chamber, and a time valve.
Figure 2:
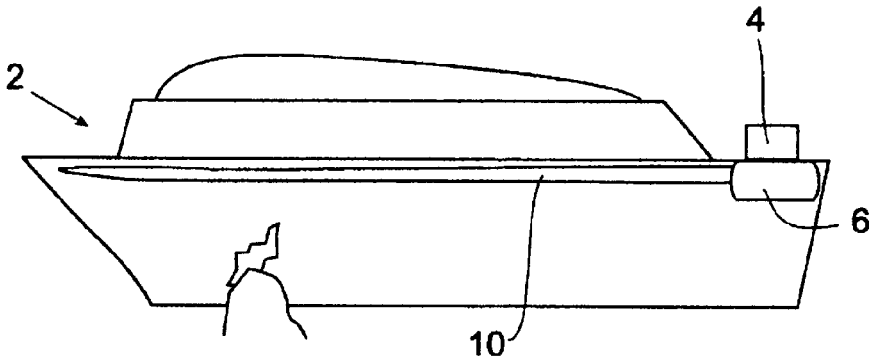
FIG. 2 is an elevational side view of a vessel of the first embodiment of this invention, partly in cut-away, illustrating a deflated bag during storage, an air compressor, a compression chamber, and a time valve. The vessel is shown as having a rupture.
Figure 3:
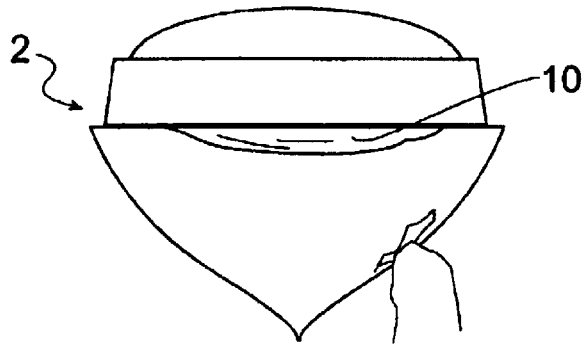
FIG. 3 is an elevational front view of a vessel of the first embodiment of this invention, partly in cut-away, illustrating a deflated bag during storage. The craft is shown as having a rupture.
Figure 4:
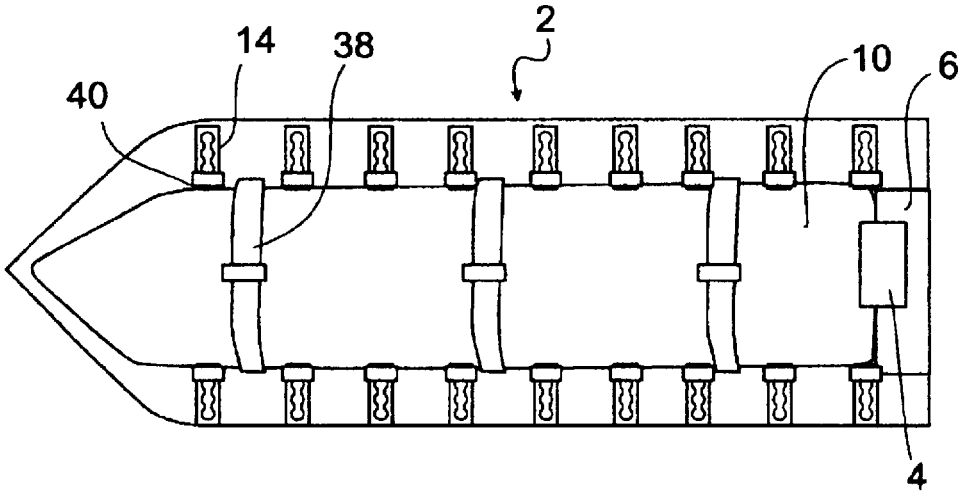
FIG. 4 is a cut-away bottom view of a vessel of the first embodiment of this invention illustrating a deflated bag during storage. The bag is held by tie-down straps. Also illustrated are diameter restrictor/gauge tracks and airbag diameter securement fasteners.
Figure 5:
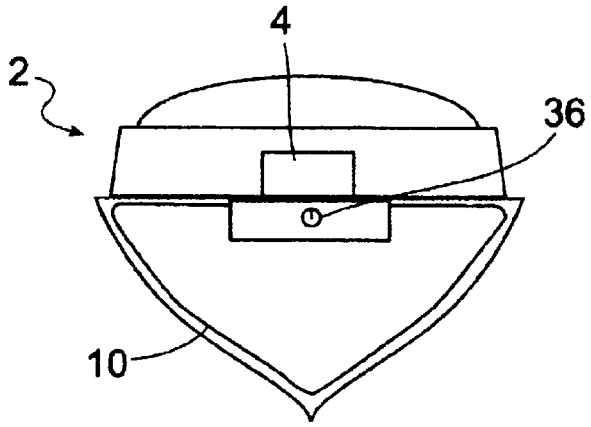
FIG. 5 is an elevational rear view of a vessel of the first embodiment of this invention, partly in cut-away, illustrating a fully inflated airbag following activation of the system of the present invention.
Figure 6:
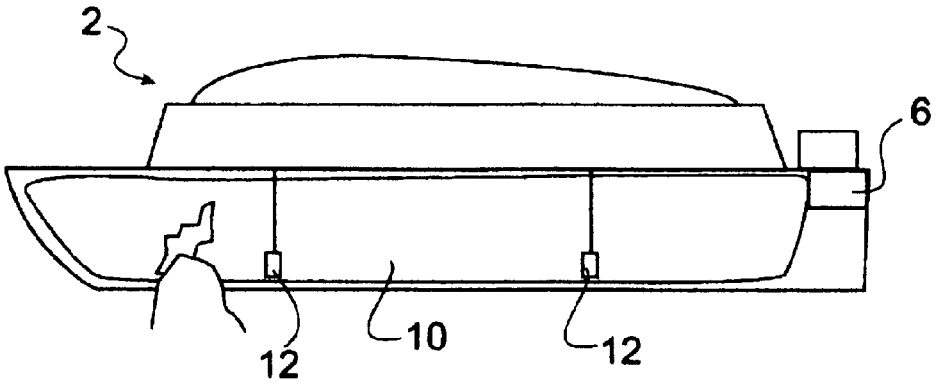
FIG. 6 is an elevational side view, partly in cut away, of a vessel of the first embodiment of this invention illustrating a fully inflated airbag pushing water out through a rupture.
Figure 7:
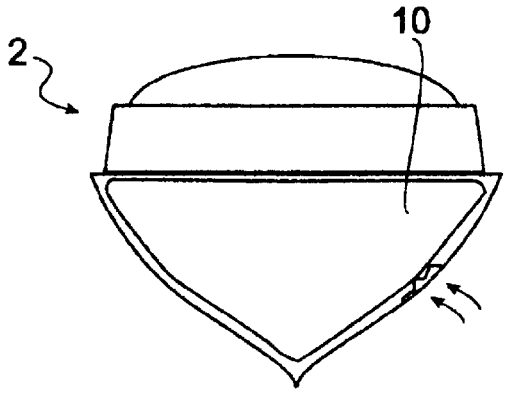
FIG. 7 is an elevational front view of a vessel of the first embodiment of this invention, partly in cut-away, illustrating a fully inflated airbag pushing water out through a rupture.
Figure 8:
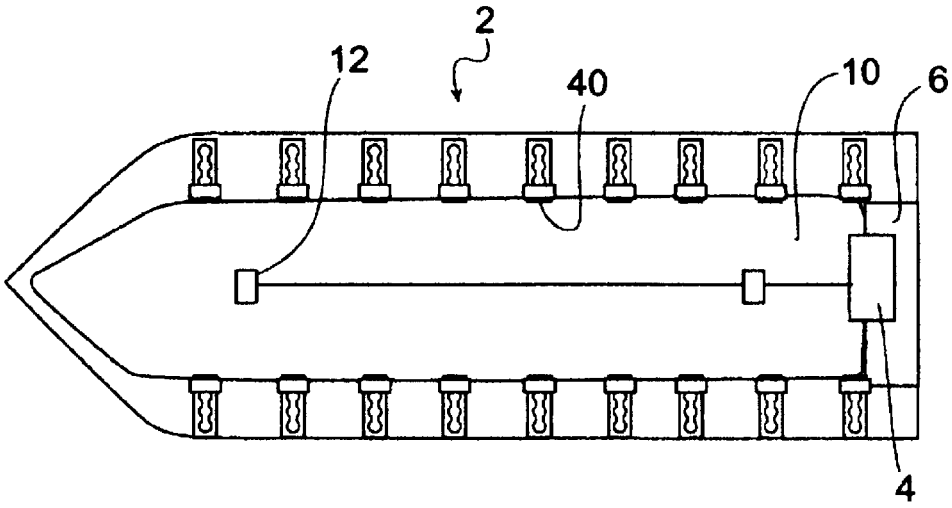
FIG. 8 is a cut-away bottom view of a vessel of the first embodiment of this invention illustrating an inflating airbag expanding on diameter restrictor/gauge tracks, an air compressor, and a compression chamber.
Figure 9:
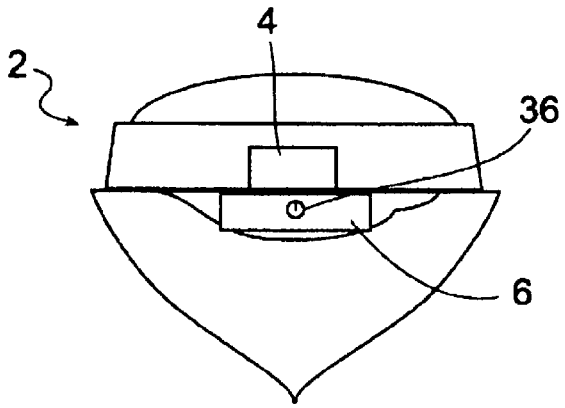
FIG. 9 is an elevational rear view of a vessel of the second embodiment of this invention, partly in cut-away, illustrating a deflated bag during storage, an air compressor, a compression chamber, and a time valve.
Figure 10:
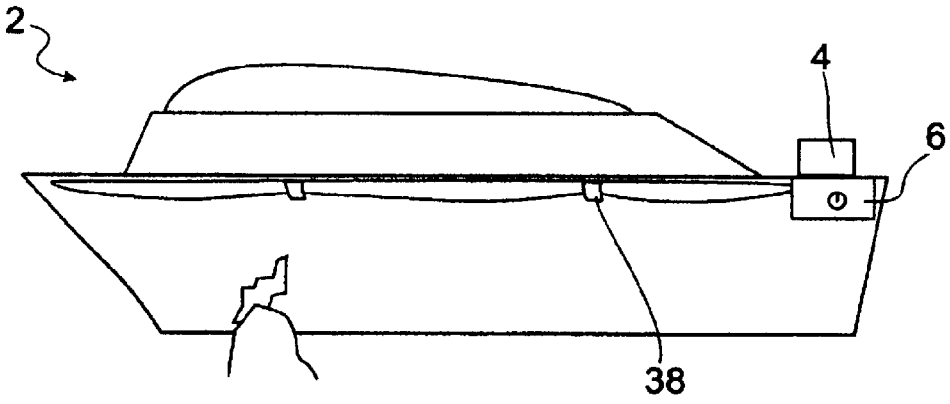
FIG. 10 is an elevational side view of a vessel of the second embodiment of this invention, partly in cut-away, illustrating a deflated bag during storage, an air compressor, a compression chamber, and a time valve. The vessel is shown as having a rupture.
Figure 11:
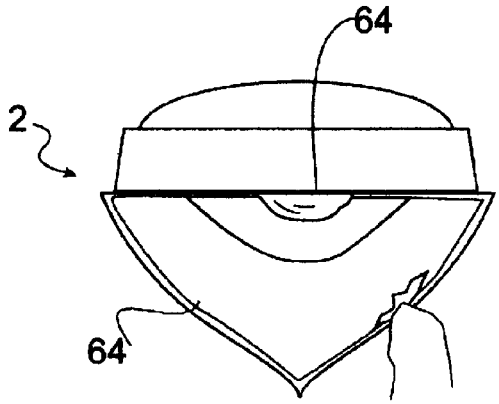
FIG. 11 is an elevational front view of a vessel of the second embodiment of this invention, partly in cut-away, illustrating a deflated bag during storage. The craft is shown as having a rupture.
Figure 12:
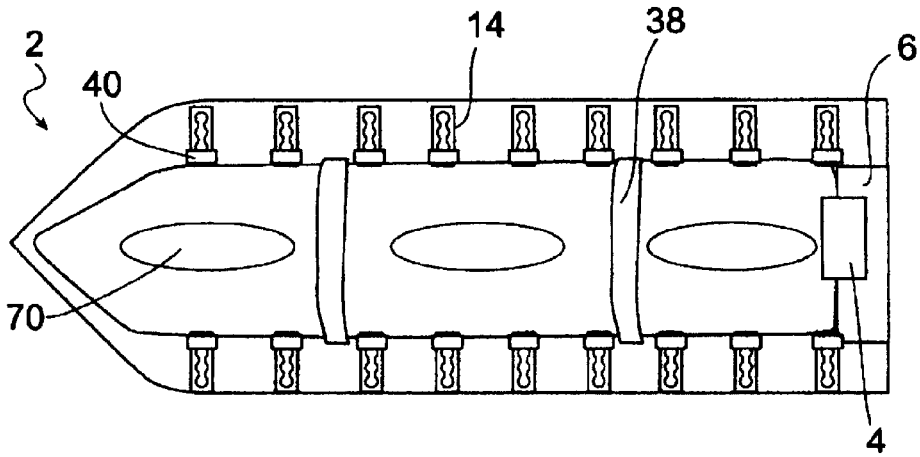
FIG. 12 is a cut-away bottom view of a vessel of the second embodiment of this invention illustrating a deflated bag during storage. The bag is held by tie-down straps. Also illustrated are diameter restrictor/gauge tracks and airbag diameter securement fasteners.
Figure 13:
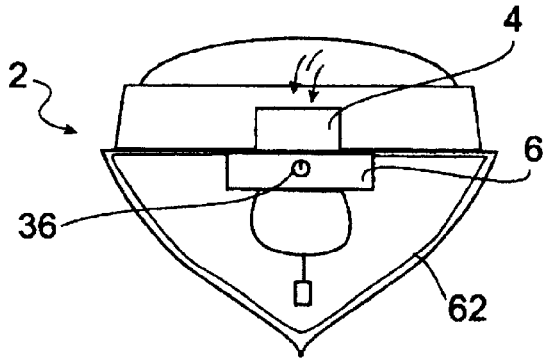
FIG. 13 is an elevational rear view of a vessel of the second embodiment of this invention, partly in cut-away, illustrating a fully inflated airbag following activation of the system of the present invention.
Figure 14:
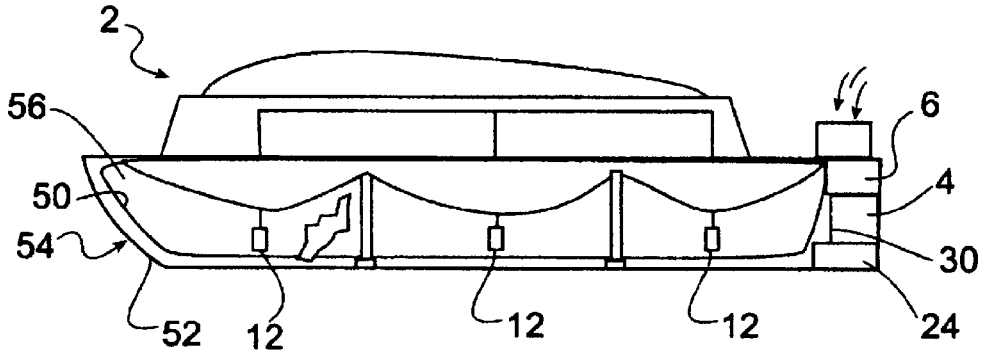
FIG. 14 is an elevational side view of a vessel of the second embodiment of this invention, partly in cut-away, illustrating a fully inflated airbag pushing water out through a rupture.
Figure 15:
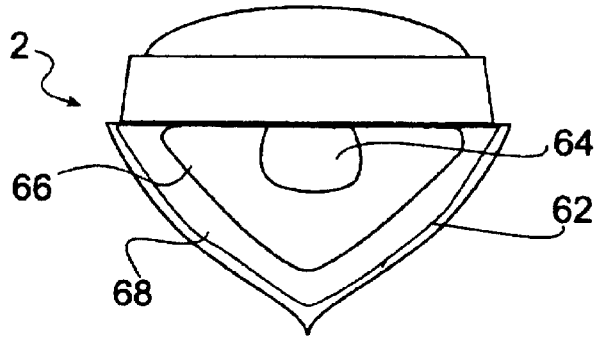
FIG. 15 is an elevational front view of a vessel of the second embodiment of this invention, partly in cut-away, illustrating a fully inflated airbag pushing water out through a rupture.
Figure 16:
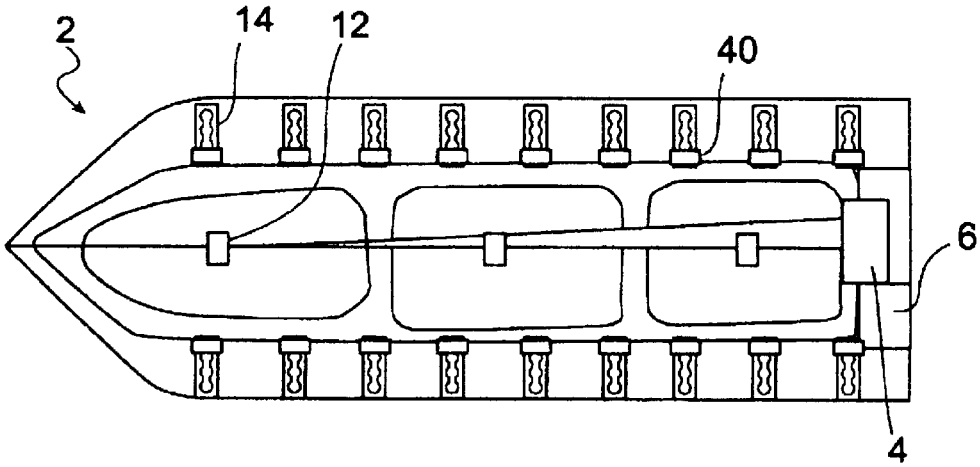
FIG. 16 is a cut-away bottom view of a vessel of the second embodiment of this invention illustrating an inflating airbag expanding on diameter restrictor/gauge tracks, an air compressor, a compression chamber, and a time valve.
Figure 17:
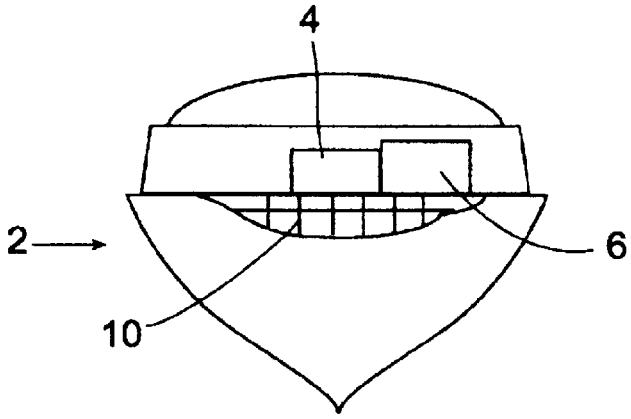
FIG. 17 is an elevational rear view of a vessel of the third embodiment of this invention, partly in cut-away, illustrating a deflated bag during storage and an air compressor.
Figure 18:
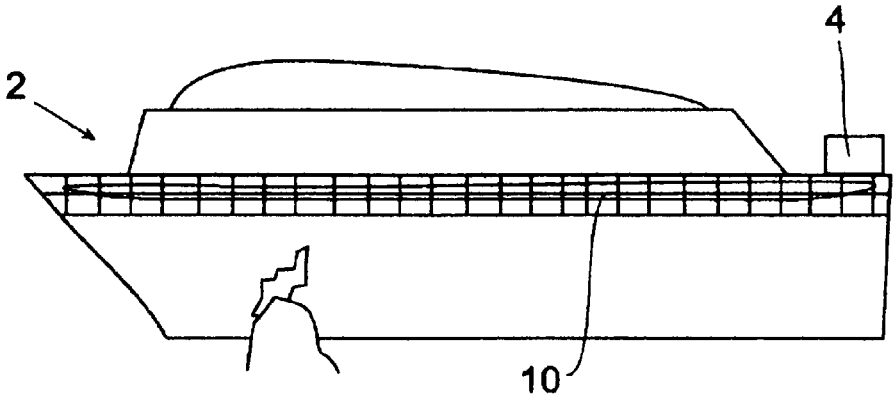
FIG. 18 is an elevational side view of a vessel of the third embodiment of this invention, partly in cut-away illustrating a deflated bag during storage and an air compressor. The vessel is shown as having a rupture.
Figure 19:
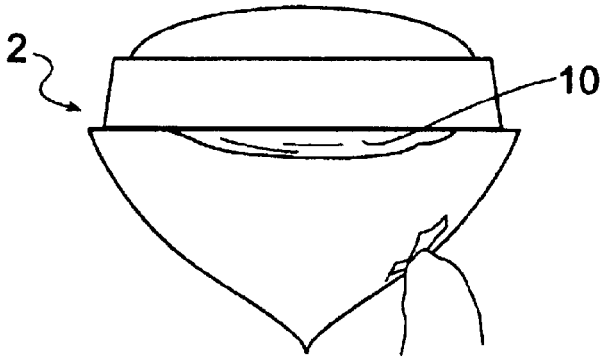
FIG. 19 is an elevational front view of a vessel of the third embodiment of this invention, partly in cut-away, illustrating a deflated bag during storage. The craft is shown as having a rupture.
Figure 20:
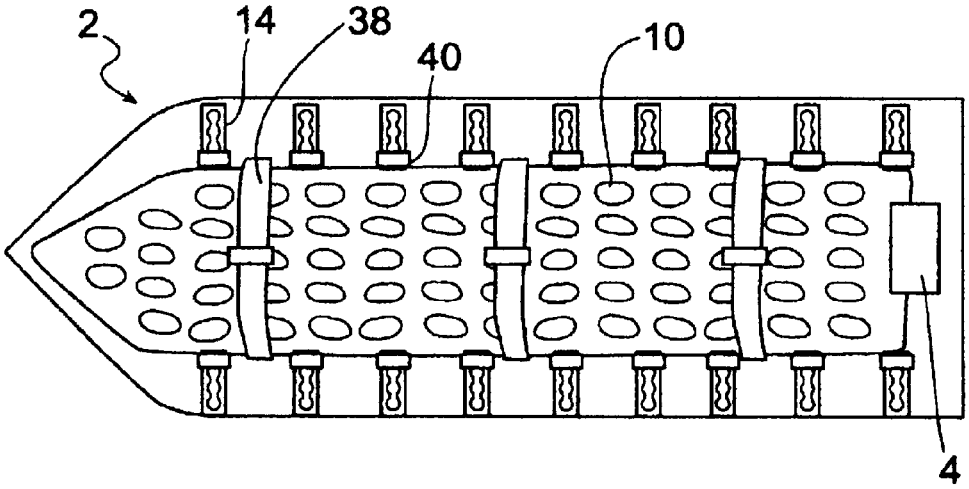
FIG. 20 is a cut-away bottom view of a vessel of the third embodiment of this invention illustrating a deflated bag during storage. The bag is held by tie-down straps. Also illustrated are diameter restrictor/gauge tracks and airbag diameter securement fasteners.
Figure 21:
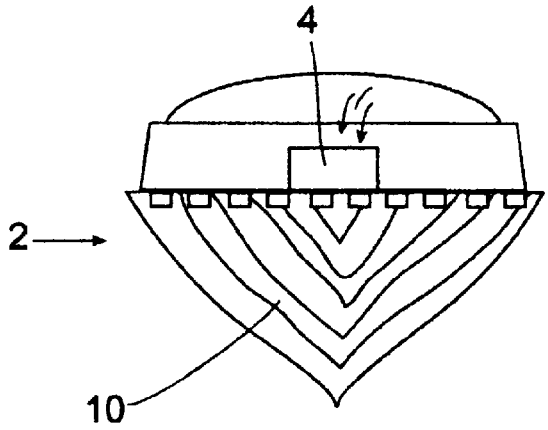
FIG. 21 is an elevational rear view of a vessel of the third embodiment of this invention, partly in cut-away, illustrating fully inflated airbags following activation of the system of the present invention.
Figure 22:
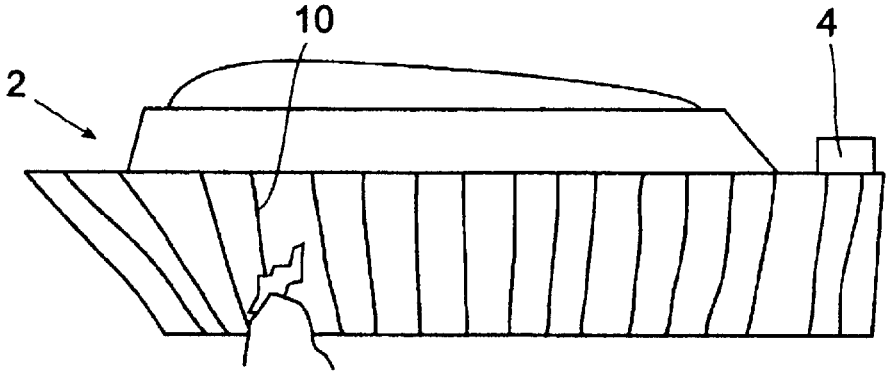
FIG. 22 is an elevational side view of a vessel of the third embodiment of this invention, partly in cut-away, illustrating fully inflated airbags pushing water out through a rupture.
Figure 23:
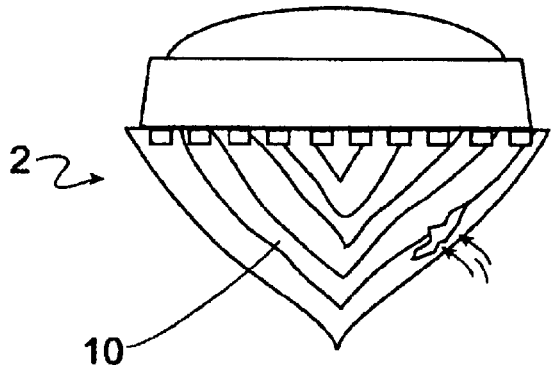
FIG. 23 is an elevational front view of a vessel of the third embodiment of this invention, partly in cut-away, illustrating fully inflated airbags pushing water out through a rupture.
Figure 24:
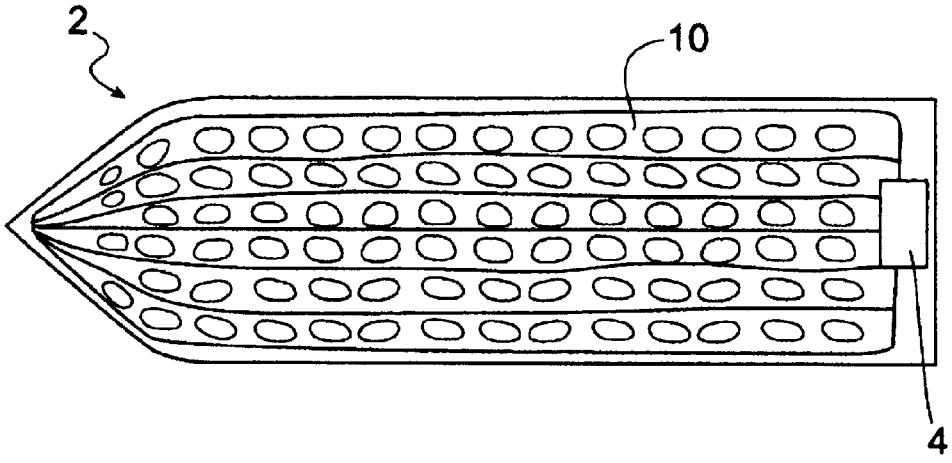
FIG. 24 is a cut-away bottom view of a vessel of the third embodiment of this invention illustrating inflating airbags expanding on diameter restrictor/gauge tracks and an air compressor.

The present invention will now be more fully described with reference to the above drawing, wherein like identifying numerals refer to like parts throughout.

Prior to the discussion of the separate embodiments of this invention, the different parts of the system of a vessel 2 will be discussed.

The separate parts of the system are at least one air compressor 4, a compression chamber 6, a compressor/propeller clutch 8, at least one inflatable airbag 10, heating elements 12, and a diameter restrictor/gauge track 14. Additional features of this invention include sonar warning system 16 for warning to avoid potential harm to the vessel 2 and a re-entry system 18 which transfers air from the inflated airbags 10 to the inside of a repaired vessel 2.

It has been seen that the systems of the prior art, especially those systems used for smaller boats wherein the airbags are on the outside of the boat, use air or other gas provided from a gas cylinder. The system of the present invention is intended for use in larger vessels 2 where size and weight of the vessel would be considerably higher and wherein gas cylinders could not supply adequate volumes of air. Thus, in the present invention, an air compressor 4 is used. Two types of air compressors are preferred, each having its own strengths and preferred times of use. Each of these air compressors is made of plastic or metal. Plastic is preferred as plastic is not affected by the sea air and water while metal is and plastic is lighter in weight than metal of a corresponding strength.

The first type of air compressor 4 is a large impeller 20-equipped compressor 4 which is capable of moving large quantities of air from the surrounding atmosphere to the compression chamber 6. This compressor 4 contains multiple long, overlapping impeller blades 20. It powers a generator 22 through electromagnetic induction provided by the vessel's 2 engine 24 through a clutch 8 to supply power to heating elements 12 for use when needed and to the control panel 28. The control panel supplies activation controls and diameter indicator lights which indicate the position of the air bag 10 along the diameter restrictor/gauge track 14. The compressor 4 is connected to a control panel 28 which provides switches for the activation of the system and/or to determine the position of the inflatable bags 10 through indicator lights connected to sensors located on the diameter restrictor/gauge tracks 14. The air compressor 4 is bolted down on the deck above the engine 24. A long axle 30 extends from the air compressor 4 into a clutch 8 device which is attached to the axles 32 connecting the engine 24 and propeller (not shown). An electric motor (not shown) is provided to power the air compressor 4 in the event of failure of the vessel's 2 engine 24. The electric motor provides a back-up system in the event of engine 24 failure. An electric cord connects the electric motor to the vessel's 2 batteries allowing the motor to spin the compressor's 4 impellers 20 as needed. To lessen the load on the electric motor, a ratchet clutch in the compressor 4 may disengage the shaft to the compressor/propeller clutch 8.

The first type of air compressor 4 is responsible for building up the necessary compression for the initial filling of the inflatable bags 10.

A second type of air compressor (not shown) may optionally be used in unison with the first type of compressor 4. The second type, a piston air compressor, may be initiated when the impeller compressor 4 has reached its maximum compression. The piston compressor is slower, but is capable of generating higher compression values. Both the impeller compressor 4 and the piston compressor are known in the art and need not be further detailed.

The compressors 4 feed atmospheric air under pressure into compression chambers 6. The compression chambers 6 are capable of holding large amounts of air under high pressure. A large diaphragm 34 makes up part of one wall of the compression chamber 6. There are three valves in the compression chamber 6. The first is a time valve 36 which opens and closes at pre-determined intervals set at the control panel 28. This valve 36 allows pressurized air to be stored and released into the inflatable bags 10. The second is made up by the throat for the piston-type compressor (not shown). The third valve is the bypass valve (not shown) for exhaust gases. Each compression chamber 6 has two water sensors (not shown) inside the chamber 6, one just below, and one just above, the time valve 36. When water is sensed, indicating the presence of water in the compression chamber 6, a signal is sent to the control panel 28 to shut down the system. This signal may be overridden by a crew member. The closing down of the system is a safety feature which prevents the taking on of water by the air compressor 4 and air compression chamber 6 in the event the vessel 2 becomes submerged or overturned. By stopping the system, the inflatable airbags 10 will retain whatever air they have rather than have the bags 10 filled with water. This feature allows the vessel 2 to maintain whatever buoyancy has been provided by the air already introduced into the system.

A compressor/propeller clutch 8 is in a T-shaped housing and permits independent or simultaneous operation of the air compressor 4 impellers 20 and propellers (not shown) for the vessel 2. A toothed gear axle 30 from the compressor 6 is attached to this clutch 8 which, in turn, is attached to the driveshaft 32 of the vessel's 2 engine 24 to turn the vessel's 2 propellers (not shown). The electrically controlled clutch 8 can be set at the control panel to run either or both the vessel's 2 propellers (not shown) and the air compressor's 4 impellers 20.

Inflatable airbags 10 are large airbags 10 made of tear- and puncture-resistant material. A wide variety of materials may be used to prepare the bags 10. Metal foil, especially aluminum foil is one example. Multi-ply rubber and canvas are other examples. The most preferred material is KEVLAR, noted for its strength and ability to resist punctures. In this respect, any one bag 10 may have multiple layers. The bags 10 may be single bags 10 or have a bag-in-a-bag configuration. The inflatable bags 10 are adapted to be inflated from an outside source of air. Thus, in the event the vessel 2 is sunk or overturned, the inflatable bags 10 may be filled with air by connecting a hose to the intake port of the compression chamber 6 and supplying pressurized air to fill the inflatable bags 10 to add buoyancy to the vessel 2.

In addition to being inflated by air from the compression chamber 6, the inflatable airbags 10 may be inflated by using the exhaust gases from the vessel's engine 24.

The inflatable airbags 10 are provided with sealed, waterproof heating elements 12. These elements 12 heat and expand the air in the bags 10 in the event a larger volume or degree of compression of the air in the bags 10 is required. Thus, if the rupture is so large that the incoming water is greater in volume than the air introduced into the airbags 10 by the compressor 4, the air in the bags 10 is heated to expand it and so provide a larger volume effect. The uninflated bags 10 are held in place by tie-down straps 38 which snap upon inflation of the bags 10.

Figure 25:
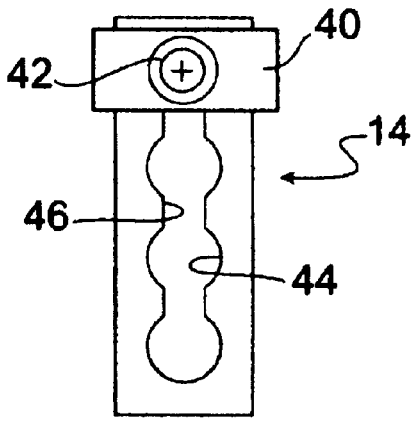
FIG. 25 is an elevational bottom view of a diameter restrictor/gauge track and an airbag diameter securement latch device coupled to it illustrating the relaxed position of the airbag diameter securement latch device secured into a fixed diameter setting and springs.
Figure 26:
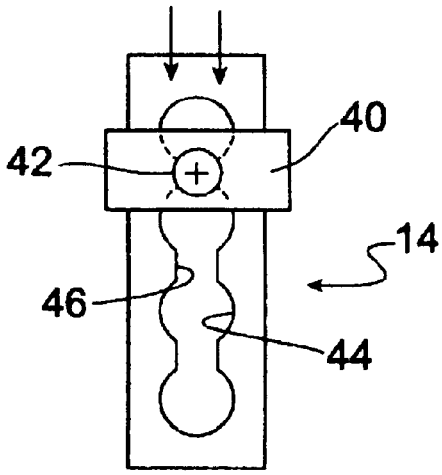
FIG. 26 is an elevational bottom view, partly in cut-away, of a diameter restrictor/gauge track and an airbag diameter securement latch device coupled to it riding the narrow neck to snap into the next setting. The Figure illustrates the compression of a spring-loading mechanism.
Figure 27:
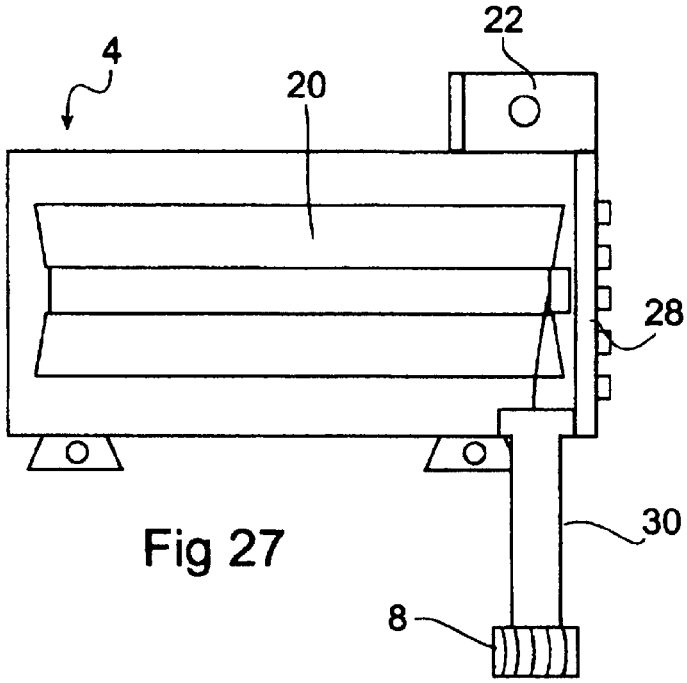
FIG. 27 is an elevational side view of an air compressor illustrating generator impellers, a partial view of the control panel, and cold air input for the heating elements.
Figure 28:
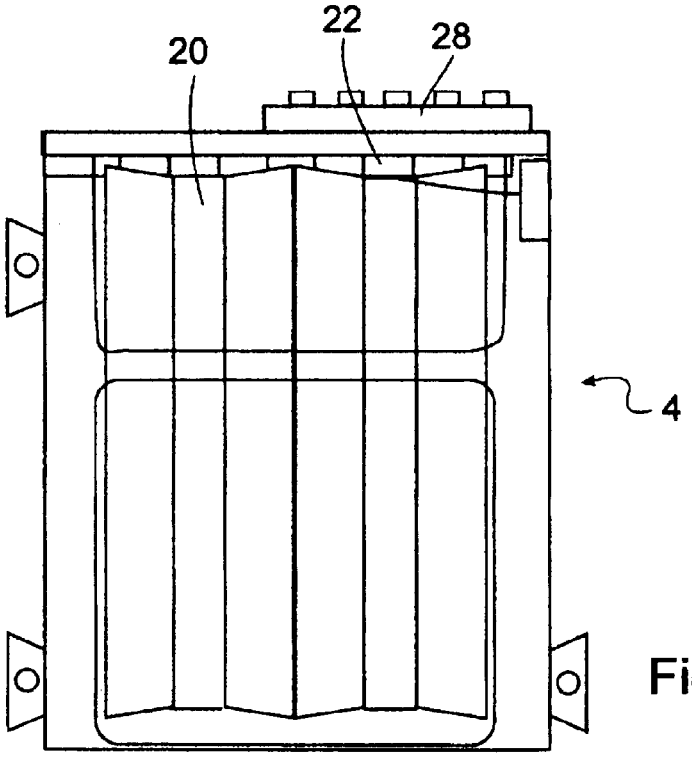
FIG. 28 is an elevational top view of an air compressor, partly in cut-away, illustrating inner gears, a generator, and an air filter.
Figure 29:
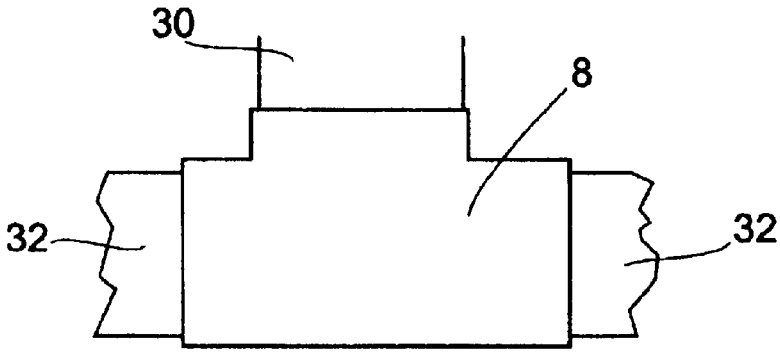
FIG. 29 is an elevational side view of a clutch device used in this invention.

The operation of the diameter restrictor/gauge track 14 and associated airbag diameter securement latch device 40 may be best understood with reference to FIGS. 25 and 26. The diameter restrictor/gauge track 14 is a slotted track on which the inflatable bag 10 rides as it is expanding toward maximum inflation. The airbag diameter securement latch devices 40 possess spring-loaded adjusting rings 42. The airbag diameter securement latch devices 40 attach the inflatable bags 10 to the diameter restrictor/gauge track 14. The track 14 provides large orifices 44 in which the male protruding nub (not shown) of the airbag diameter securement latch device 40 is secured in a relaxed manner, allowing the buildup of air pressure. Pressure from the air compressor 4 forces the airbag diameter securement latch device 40 along the track 14 to larger diameter settings. In doing so, the spring-loaded adjusting ring 42 of the airbag diameter securement latch device 40 is compressed, which causes it to go into the narrow passage 46 and ultimately into the next large relaxed orifice 44 setting where it snaps back open, securing the position of the inflatable bag 10 until increased back pressure becomes so great as to push it through the next narrow passage 46.

Each bag 10 contains a diameter track guide/securement latch 48, which is a coupling attaching the airbag 10 to the tracks 14 at the perimeter of the airbag 10 which rides along the tracks 14. As noted above, pressure within the airbag 10 overcomes the resistance of the tracks 14 by forcing the spring-loaded adjustment ring 42 of the airbag securement latch device 40 to compress and ride through the narrow passages 46, snapping into the next large orifice 44.

In each of the embodiments, the inflatable bag 10 may be placed between the inner 50 and outer 52 walls of the hull 54 or may be placed in the open space of the interior 56 of the vessel 2. It is required that the space for the bag 10 be enclosed so that the bag 10, upon inflating, will not expand into the atmosphere surrounding the vessel 2 but will tend to form pressure against the inner 50 and/or outer wall 52 of the hull 54.

When the inflatable bag 10 is located in the interior 56 of the vessel 2, it will, upon inflating, form pressure against the inner aspect of the inner wall 50 of the hull 54 and lend buoyancy to the interior 56 of the vessel 2. When forming pressure against the inner wall 50 of the hull 54, water is kept from entering the interior 56 of the vessel 2.

When the inflatable bag 10 is located between the inner 50 and outer 52 walls of the hull 54, it will, upon inflating, form pressure against both the inner 50 and outer 52 walls of the hull 54 and lend buoyancy to the space between the inner 50 and outer 52 walls of the hull 54. When forming pressure against the inner 50 and outer 52 walls of the hull 54, water is kept from entering the space between the inner 50 and outer 52 walls of the hull 54 and is kept from entering the interior 56 of the vessel 2.

The first embodiment will now be described with reference to FIGS. 1–8.

In the first embodiment, a series of single bags 10 (as opposed to a bag within a bag) is deployed on the diameter restrictor/gauge track 14 by the airbag securement latch device 40. The bags 10 are deployed on the interior of the hull 54. Upon activation, the compressor 4 forces air under pressure into the compression chamber 6. The time valve 36 of the compression chamber 6 opens at designated time intervals which vary according to the size of the vessel 2. Upon opening of the time valve 36, air is sent through primary conduits 58 (pipes and/or hoses) to the inflatable bags 10. The primary conduits 58 branch off into secondary conduits 60 which contain one-way valves (not shown). These valves prevent the loss of air in the remainder of the system in the event one bag 10 is ruptured. Inflation of the inflatable bags 10 adds buoyancy to the vessel 2 to keep it afloat. In the event the rupture to the hull 54 has penetrated both the inner 50 and outer 52 wall of the hull 54, the pressure of a bag 10 against the inner aspect of the inner wall 50 of the hull 54 will tend to confine the water to the space between the inner 50 and outer 52 walls of the hull 54. In the event the inflatable bag ruptures 10, the continued feeding of pressurized air to the ruptured bag 10 will result in the feeding of air to a sealed-off compartment of the vessel 2. This will tend to prevent complete flooding of the compartment.

Figure 30:
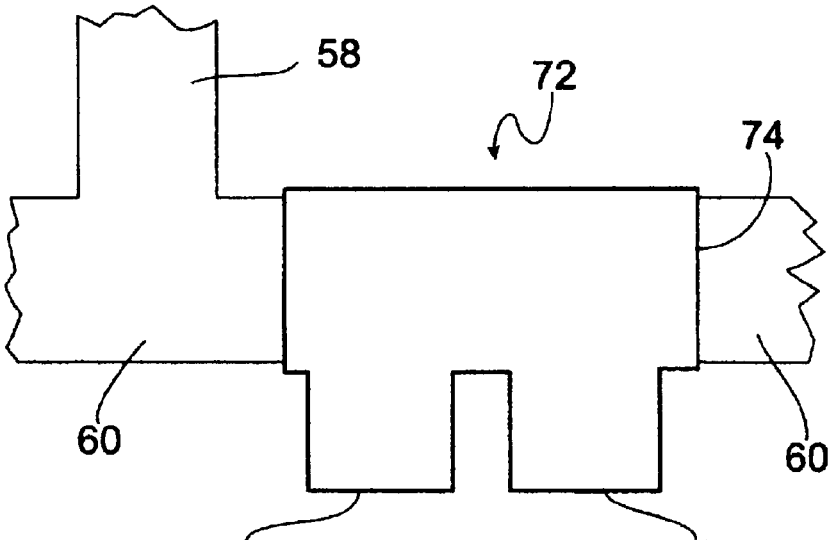
FIG. 30 is an elevational side view of a primary conduit, a secondary conduit, and an inter-bag valve.
Figure 31:
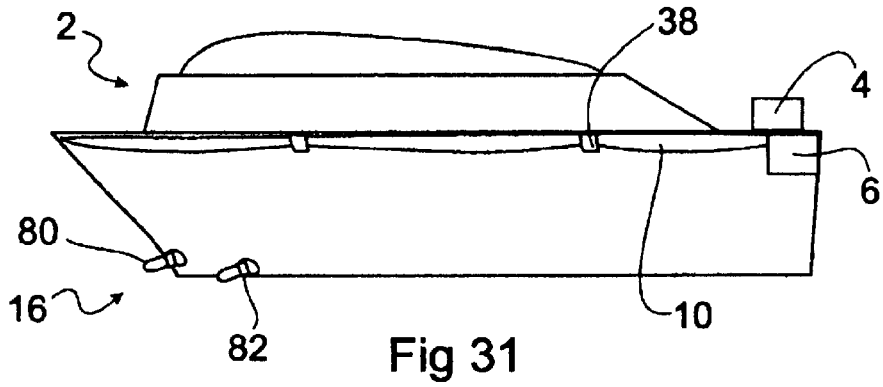
FIG. 31 is an elevational side view, partly in cut-away, of a vessel containing the warning system which is part of this invention.
Figure 32:
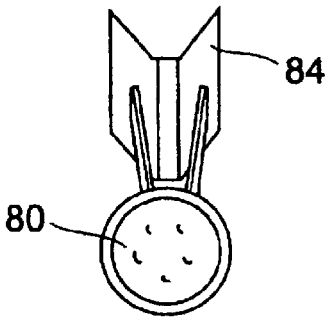
FIG. 32 is an elevational front view of sonar equipment which may be used in this invention.
Figure 33:
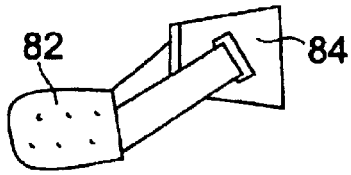
FIG. 33 is an elevational perspective view of sonar equipment which may be used in this invention.
Figure 34:
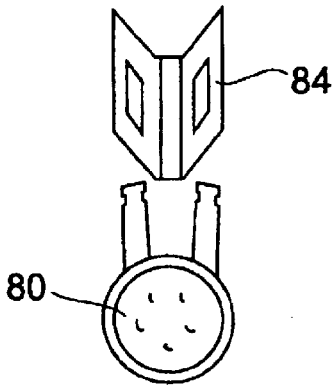
FIG. 34 is an elevational exploded front view of sonar equipment which may be used in this invention.
Figure 35:
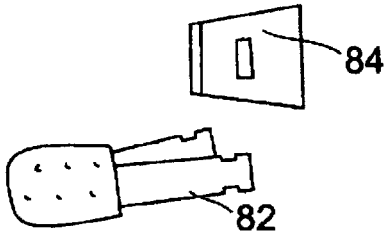
FIG. 35 is an elevational exploded perspective view of sonar equipment which may be used in this invention.

In the second embodiment, a series of three-chambered main airbags 62 (a bag-within-a-bag-within-a-bag) having an inner chamber 64, a central chamber 66, and an outer chamber 68 along with smaller auxiliary inflatable bags 70 at the top of the main bags 62 is deployed on the diameter restrictor/gauge track 14 by the airbag securement latch device 40. The bags 62, 70 are deployed on the interior of the hull 54. Upon activation, the compressor 4 forces air under pressure into the compression chamber 6. The time valve 36 of the compression chamber 6 opens at designated time intervals which vary according to the size of the vessel 2. Upon opening of the time valve 36, air is sent through primary conduits 58 (pipes and/or hoses) to the inflatable bags 10. The primary conduits 58 branch off into secondary conduits 60 which contain one-way valves. These valves prevent the loss of air in the remainder of the system in the event one bag 62, 70 is ruptured. As shown in FIG. 30, the system having three-chambered bags 62 contains a series of inter-bag valves 72 which separate the chambers 64, 66, 68 from each other. These valves 72 permit the inner chambers 64 to be filled first as ports 74 to these chambers 64 are free. After the inner chamber 64 is pressurized to its maximum capacity, a butterfly valve (not shown) seals the port to the inner chamber 64 to shut off and lock this port so that no air can leave or enter the inner chamber 64 and all additional air from the compressor 4 is directed into the central 66 and outer 68 chambers. The central 66 and outer 68 chambers also contain butterfly valves that seal the ports to these chambers 66, 68 when maximum pressure is attained. These valves are spring loaded and are capable of reopening to allow the entrance of air if the pressure in the chambers 64, 66, 68 drops below the set maximum pressure. However, the entrance ports 76, 78 to the central 66 and outer 68 chambers of the three-chambered bags 62 are later pressure-loaded to the maximum pressure setting of the inner chambers 64. After the maximum pressure setting of the inner chamber 64 is attained, a butterfly valve (not shown) seals the port 74 to the inner chamber 64 so that no air can leave or enter the inner chamber 64 and all additional air from the air compressor 4 is directed into the central chamber 66 and then into the main outer chamber 68. The central chamber 66 and the main outer chamber 68 possess reverse butterfly valves (not shown) which close when maximum pressure is attained. These valves may be reopened if the pressure within the controlled chamber 66, 68 drops below the maximum setting. These valves are electrically connected to the compressor 4 controls so that the compressor 4 may be shut down when all of the valves are closed and is opened when one or more of the valves is opened. Inflation of the inflatable bags 62, 64 adds buoyancy to the vessel 2 to keep it afloat. In the event rupture to the hull 54 has penetrated both the inner 50 and outer 52 wall of the hull 54, the pressure of a bag 62, 70 against the inner aspect of the inner wall 50 of the hull will tend to confine the water to the space between the inner 50 and outer 52 walls of the hull 54. In the event the outer chamber 68 of the main bag 62 ruptures, the presence of inflated central 66 and inner 64 chambers and auxiliary bags 70 will maintain pressure against the inner aspect of the inner wall 50 to continue to maintain pressure against the incoming water, and will tend to confine the incoming water to the space between the inner 50 and outer 52 walls of the hull 54.

In the third embodiment, a series of single bags 10 is deployed on the diameter restrictor/gauge track 14 by the airbag securement latch device 40. The bags 10 are deployed between the inner 50 and outer 52 walls of the hull 54. Upon opening of the time valve 36, air is sent from the compression chamber 6 through primary conduits 58 (pipes and/or hoses) to the inflatable bags 10. The primary conduits 58 branch off into secondary conduits 60 which contain one-way valves (not shown). These valves prevent the loss of air in the remainder of the system in the event one bag 10 is ruptured. The inflation of the inflatable bags 10 adds buoyancy to the vessel 2 to keep it afloat. The pressure of a bag 10 against the inner aspect of the outer wall 52 of the hull 54 will tend to prevent the water from entering the space between the inner 50 and outer 52 walls of the hull 54. Should both the inner 50 and outer 52 walls of the hull 54 be ruptured, pressure of the inflatable bag 10 against the inner wall 50 of the hull 54 tends to cover the point of rupture of the inner hull and prevent water from entering the interior of the vessel.

While it is intended to present a system which will be capable of keeping a vessel 2 afloat in the event the hull 54 has been punctured, it is obvious that it is best if the system is never needed. For this reason, the inventor has coupled the above-described buoyancy system with a sonar warning system 16 to be described below.

The warning system 16 can best be understood by reference to FIGS. 31–35. According to this invention, the transmitter 80 and the receiver 82 may be located in a single unit or in two separate units. Both the transmitter 80 and the receiver 82 are located on the exterior of the vessel 2 in such a way that they may be easily removed. This includes attachment bases 84 attached to the front of the vessel 2 and a transmitter 80 and receiver 82 removably attached to the attachment bases 84. The sonar system 16 is to be used in conjunction with the buoyancy system in order to provide a safety system. The first element of the safety system warns of danger and allows the controller of the vessel 2 to avoid danger. The second element of the safety system provides for buoyancy and water elimination in the event of rupture in spite of the presence of the first element.

The deployment of the above-described system adds buoyancy to the vessel 2 and also prevents water from entering the vessel 2. This gives the crew time to make temporary repairs to the hull 54 which may be in the form of sealants or welded patches.

Figure 36:
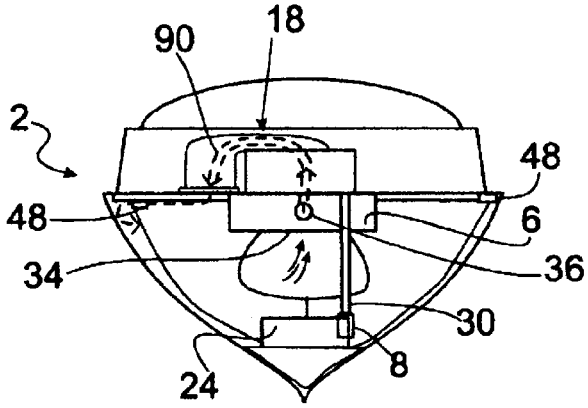
FIG. 36 is a rear elevational view, partly in cut-away showing a re-entry system of the present invention.
Figure 37:
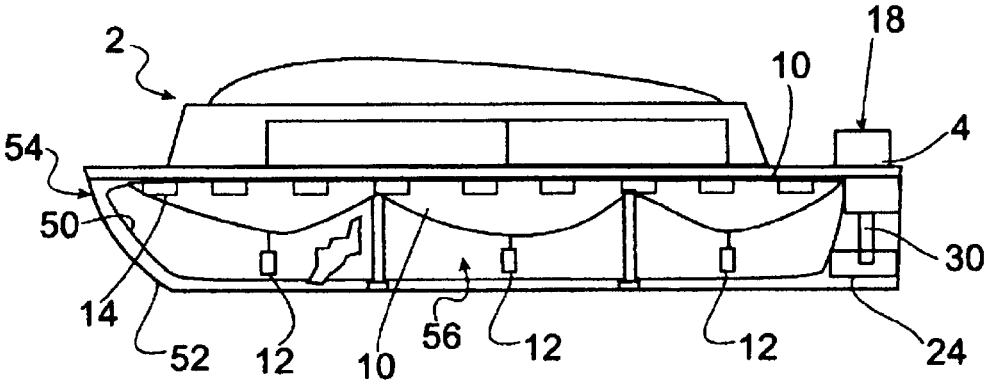
FIG. 37 is a side elevational view, partly in cut-away, showing a re-entry system of this invention.

With reference to FIGS. 36 and 37, a reentry system 18 is described which finds utility following the stopping of water intake and repair of the rupture of the hull 54. Once air in the inflatable bags 10 is no longer necessary, the air may be released through escape valves (not shown). In the event it is still necessary or desirable to have pressurized air in a compartment which has a slow leak, air may be transferred from an inflated bag 10, through the air compression chamber 6, and through an air re-entry conduit 90 to the affected sealed compartments where pressurized air is desired.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. In a vessel having hull having an interior and a ceiling, which ceiling has an upper surface and a lower surface, the improvement comprising a system which renders the vessel unsinkable, which system comprises:

a) an air compressor which feeds air under pressure to a compression chamber, b) a compression chamber which feeds air under pressure to at least one inflatable airbag, and c) at least one inflatable airbag stored on the lower surface of the ceiling of the hull.

2. The vessel of claim 1, wherein the vessel contains an engine.

3. The vessel of claim 2, wherein there is at least one slotted track for holding the at least one inflatable airbag in an uninflated condition and allowing the at least one inflatable airbag to expand.

4. The vessel of claim 3, wherein at least one single airbag is deployed on the track by at least one device which attaches the airbag to the slotted track on the interior of the hull.

5. The vessel of claim 2, wherein the hull has inner and outer walls and to at least one single airbag is deployed on the slotted track by at least one device which attaches the airbag to the slotted track between the inner and outer walls of the hull.

6. The vessel of claim 2, wherein the vessel includes a sonar warning system for warning of potential harm to the vessel.

7. The vessel of claim 2, wherein the system contains a re-entry system which transfers air from the inflated airbags to the interior of the vessel.

8. The vessel of claim 2, wherein the air compressor contains multiple overlapping impeller blades.

9. The vessel of claim 2, wherein the air compressor is connected by an axle to a clutch device which is attached to an axle from the vessel's engine.

10. The vessel of claim 2, wherein the at least one compression chamber is capable of holding air under pressure, a diaphragm makes up part of one wall of each compression chamber, and a time valve opens and closes at pre-determined intervals allowing pressurized air to be stored and released into the inflatable airbags.

11. The vessel of claim 2, wherein the at least one inflatable bag is provided with a heating element.

12. The vessel of claim 2, wherein the at least one inflatable airbag is at least one three-chambered main airbag having an inner chamber, a central chamber, and an outer chamber.

13. The vessel of claim 12, wherein there is at least one smaller auxiliary inflatable airbag located at the top of the main airbag.

14. The vessel of claim 12, wherein there is at least one diameter restrictor/gauge track for holding the at least one inflatable airbag in an uninflated condition and allowing the at least one inflatable airbag to expand.

15. The vessel of claim 14, wherein the at least one inflatable airbag is connected to the diameter restrictor/gauge truck by at least one airbag securement latch device on the interior of the hull.

16. The vessel of claim 14, wherein the hull has inner and outer walls and the at least one inflatable airbag is connected to the diameter restrictor/gauge track by at least one airbag securement latch device between the inner and outer walls of the hull.

17. The vessel of claim 12, wherein the chambers of the three-chambered main airbag are connected by a series of inter-bug valves.

18. The vessel of claim 12, wherein the vessel includes a sonar warning system for warning of potential harm to the vessel.

19. The vessel of claim 12, wherein the vessel includes a re-entry system which transfers air from the inflated airbags to the inside of the vessel.

* * * * *